United States Patent [19]

Gasser

[11] Patent Number: 4,896,401

[45] Date of Patent: Jan. 30, 1990

[54] COMBING CYLINDER FOR A COMBING MACHINE

[75] Inventor: Hermann Gasser, Frauenfeld, Switzerland

[73] Assignee: Galipag, Frauenfeld, Switzerland

[21] Appl. No.: 181,488

[22] Filed: Apr. 14, 1988

[30] Foreign Application Priority Data

Apr. 15, 1987 [CH] Switzerland ..... 466/87

[51] Int. Cl.[4] ..... D01G 19/04

[52] U.S. Cl. ..... 19/233

[58] Field of Search ..... 19/234, 233, 225, 105

[56] References Cited

U.S. PATENT DOCUMENTS 1,408,438 3/1922 Bricka ..... 19/234
3,169,278 2/1965 Aoki ..... 19/105
3,922,757 12/1975 Horiuchi et al. ..... 19/234

FOREIGN PATENT DOCUMENTS 1031418 6/1966 United Kingdom ..... 19/234

*Primary Examiner*—Andrew M. Falik
*Attorney, Agent, or Firm*—Collard, Roe & Galgano

[57] ABSTRACT

A combing cylinder for a combing machine having a combing segment with a wing-shaped profile. This segment is fastenend on the body of the cylinder. An air duct is arranged between the inside surface of the combing segment and the outer cylindrical surface of the cylinder body. Because of the cooperation between the wing-shaped profile of the combing segment and the air duct, the air flow produced by the rotation of the cylinder causes a suction effect which pulls the fibers towards the advancing comb. This suction assures early engagement of the fiber fringe to be combed by the teeth of the combing segment.

9 Claims, 1 Drawing Sheet

COMBING CYLINDER FOR A COMBING MACHINE

BACKGROUND OF THE INVENTION

1. Field of the Invention

The invention relates to a combing cylinder for a combing machine. Specifically, this invention relates to a combing cylinder having a wing-shaped combing segment which acts to pull fibers towards the comb.

2. Description of the Prior Art

Combing machines are used for combing out fibers such as in making high quality yarns. In the course of such combing, the individual fibers of a group or fringe of fibers are held fast between a nipper and a cushion plate which form pincers aligned parallel with one another. In the combing operation, the fibers are cleansed of contaminations and short or tangled fibers are removed.

The active part of the combing machine is a combing segment seated on the body of the combing cylinder. Such a segment has a number of rows of teeth or needles arranged on its outside surface. The teeth or needles of the combing segment engage and comb the fiber fringe fed to it by the pair of pincers. Such teeth or needles can be fully effective only if they act on the group of fibers before the combing period starts, i.e., from the moment at which the leading edge or beginning of the combing segment seated on the rotating cylinder arrives at the meeting point of the pincers. This condition is generally not met, especially if the combing cylinder is rotated at high speeds (RPM). This is because the front-most needles or teeth engage the fiber fringe only after they have moved away from the pincers.

In order to permit the fibers to be acted on at an earlier point in time, it has been proposed by U.S. Pat. No. 3,922,757, which issued to Horiuchi et al, to reduce the gap or clearance between the lower part of the pincers and the beginning of the combing segment by providing a specially shaped combing segment. Specifically, Horiuchi teaches that the combing segment is mounted on the combing cylinder at a greater distance from the axis of rotation at the starting point of the combing segment than the distance to the rotational axis at the end of the combing segment. In this way, the leading edge of the combing segment is brought much closer to the meeting point of the pincers. However, it has been found, especially with high-speed combing machines, that the group of fibers nevertheless is still not acted upon at the start of the combing period. Thus, the combing segment is not effective over the entire combing period.

SUMMARY OF THE INVENTION

It is therefore an object of the invention to provide a combing cylinder having a combing segment which is fully active throughout the entire combing period, i.e., which immediately seizes the fiber fringe at the point where it is held by pincers.

It is a further object of the invention to provide a combing cylinder in which the combing segment is so shaped and spaced from the main body of the cylinder that a suction is developed at its leading edge during the high speed rotation of the combing cylinder.

It is yet another object of the invention to provide a combing cylinder having enhanced combing abilities and which is simple in design and economical to manufacture.

Accordingly, these objects are achieved by a rotatable combing cylinder having a combing segment with a wing-shaped profile. The wing-shaped combing segment is spaced a predetermined distance radially outwardly from the surface of the cylinder body thereby defining an air flow passageway or air duct above the cylinder and under the wing. The air flow passageway increases in width as it moves from the leading edge of the wing-shaped combing segment toward the trailing edge of the segment.

The present invention is based on the realization that the inadequate engagement of the fiber fringe by the combing segment is not caused, as assumed by the above-mentioned patent, by the excessive distance or clearance between the pincers and the combing segment, but by the air that is expelled or driven out by the front of the combing segment as such front advances during the rotation of the combing cylinder. This air lifts the fiber fringe and thereby moves it away from the path of the combing segment.

The combing cylinder of the present invention not only eliminates the negative effect of the air so displaced, but also produces a suction effect for guiding or bringing the fiber fringe towards the leading edge of the combing segment. The suction is produced by the cooperation between the air foil or wing-shaped profile of the combing segment and the air duct positioned between the inside surface of the combing segment and the outer cylindrical surface of the cylinder body. This novel design for feeding the fiber causes not only the early engagement between the teeth of the combing segment and the fiber fringe but also a superior penetration of such fiber fringe through the teeth of the combing segment. This produce a much more efficient combing action. In other words, in the present invention the flow of air is equivalent to a second "pincing tool" which acts on the free end of the fiber fringe to feed the latter toward the teeth of the combing segment.

Arranging the air flow passageway or air duct, which preferably widens toward the end or trailing edge of the combing segment, between the wing-shaped combing segment and the body of the cylinder produces a zone of low pressure on the outer side of the combing segment and a zone of high pressure on the inner side, i.e., between the combing segment and the body of the cylinder. In order to minimize the influence of an incorrect angle of attack of the air flow, the leading edge of the profile is preferably designed relatively thick. This design is especially advantageous under unstable or complicated flow conditions. Although the resistance to air flow is only of relatively minor importance in connection with the combing segment design, a wing design having a thick profile nose or leading edge causes an increased resistance to air flow and is better suited for a combing cylinder revolving at low RPM.

To ensure that the fiber fringe is engaged at the earliest possible point in time, the front teeth or needles of the combing segment are arranged a short distance behind the leading edge of the profile so that the suction effect is fully developed even before the combing period starts. Thus, the fiber fringe is fed into the combing segment by the suction effect and is acted on by the leading edge of the combing segment.

These and other objects and advantages of the present invention will become apparent from the following description of the accompanying drawing, which discloses one embodiment of the present invention. It is to be understood that the drawing is to be used for the purpose of illustration only, and not as a definition of the invention.

BRIEF DESCRIPTION OF THE DRAWING

In the drawing, where similar reference numerals denote similar elements throughout the several views.

DESCRIPTION OF THE PREFERRED EMBODIMENT

Figure 1:
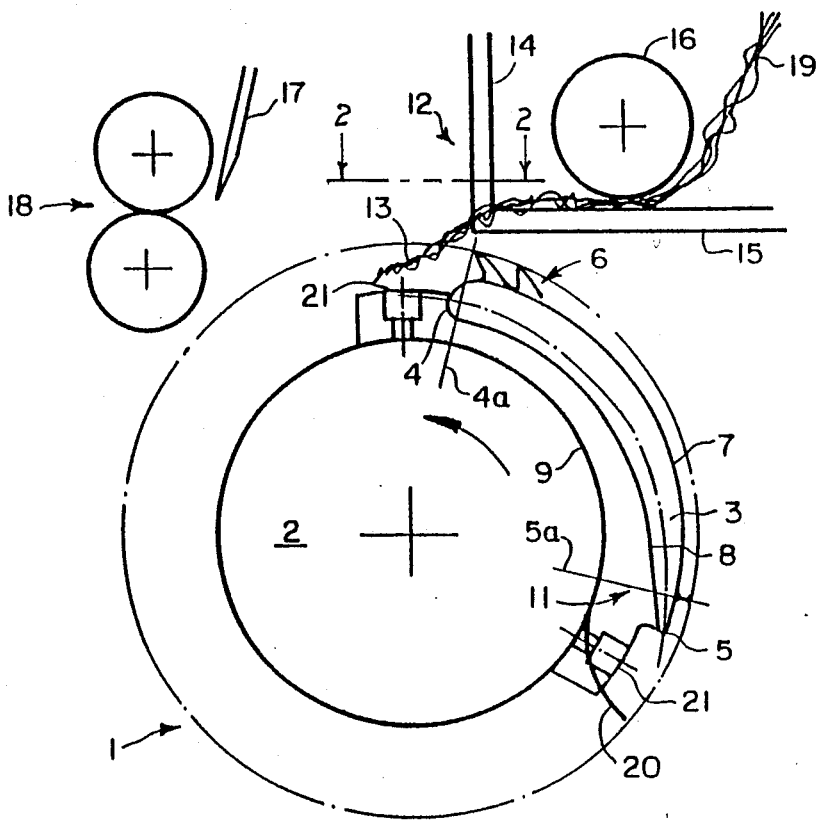
FIG. 1 is a schematic side view of the principal portions of a combing apparatus according to the present invention and FIG. 2 is a view of the combing segment taken in the direction of line 2—2 of FIG. 1 shown without the teeth.
Figure 2:
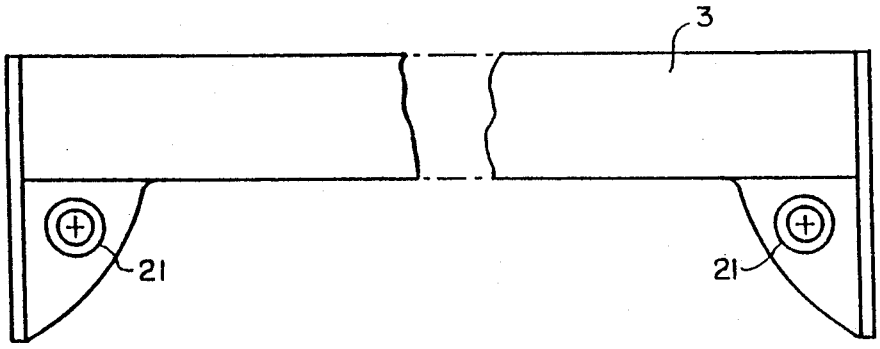

Referring to the drawing, there is shown an apparatus having a combing cylinder 1 with cylinder body 2 supporting a combing segment 3. At its front end 4 and its rear end 5, combing segment 3 is fastened on body 2 of cylinder 1 by means of four fastening flanges 21. Combing segment 3 has an outer surface 7 fitted with teeth 6, and an inner surface 8 facing the outer surface 9 of cylinder body 2. Outer surface 7 has a greater curvature than that of inner surface 8, thereby defining an air foil or wing-shape. Inner surface 8 and surface 9 define an air duct which widens towards rear end 5 of combing segment 3.

The two surfaces 8 and 9 are smooth in order to keep the frictional resistance as low as possible. When using cylindrical bodies having recesses, for example, for balancing reasons, a continuous (i.e., both closed and smooth) surface 9 can be obtained by coating any discontinuities in the outer surface of cylindrical body 2 with a thin foil material. As can be seen in the drawing, the size of teeth 6 are larger along line 4*a* of the combing segment 3 and decrease in size upon moving from beginning 4 in the direction of end 5 and are shortest along line 5*a*.

A pair of pincers comprised of a top jaw or nipper 14 and a bottom jaw or cushion plate 15 are arranged above combing cylinder 2. These jaws grip the fiber fringe 13 fed to them. A feed roller 16 is disposed above bottom jaw 15. Downstream of combing cylinder 2 is a top comb 17 which is, in turn, followed by a pair of detaching rollers 18.

In the combing operation, a predetermined quantity of fiber material 19 is fed by feed roller 16 to pincers 12. The jaws 14 and 15 periodically open and close, thereby producing the gripping action of the pincers. This action releases one fiber fringe and subsequently clamps a new fiber fringe. Fiber fringe 13 is fed by the suction effect developed by the counterclockwise rotation of combing cylinder 2 of the present invention towards the approaching combing segment 3. This results in the fiber fringe being acted on by the teeth 6 and combed through. Thereafter, top comb 17 lowers itself and the pair of tear-off rollers 18 grips the fibers 13 and pulls them from the open pincers 12, tearing them off, while the uncombed end of the fiber fringe is combed out on top comb 17.

Of course, other embodiments of the invention are feasible. For example, the combing segment may support identically sized teeth extending across its length in the manner of a carding machine coating. In this case, the outer or top contour of the combing segment is a circular arc, and the profile of the wing is solely determined by the inner (lower) contour. In this case, the inner contour has less of an arch than the outer contour, and may even be a straight line. Also, a spoiler 20 may be arranged at end 5 of the combing segment and extend outwardly of the air foil into the airstream so as to augment the aerodynamic effect.

The combing cylinder according to the present invention enhances the efficiency of the combing process even at high operating speeds. It permits combing at increased speeds while retaining the combing effect achieved at lower speeds.

While several embodiments and examples of the present invention have been described and/or shown, it is obvious that many changes and modifications may be made thereunto, without departing from the spirit and scope of the invention.

What is claimed is:

1. A combing cylinder in combination with a combing machine, said combing cylinder comprising:

a body having an outer curved surface; and a wing-shaped combing segment secured to said body at a predetermined distance radially outward of said outer curved surface thereof, said wing-shaped combing segment having a front end and a rear end and also an outer surface and an inner surface, the latter of which, together with a portion of said outer curved surface of said body defines an air flow passageway therebetween.

2. A combing cylinder as set forth in claim 1, wherein said air flow passageway widens towards said rear end of said wing-shaped combing segment.

3. A combing cylinder as set forth in claim 1, wherein said wing-shaped combing segment has teeth on said outer surface thereof, said teeth having ends arranged in a plane extending concentric with said outer curved surface of said body.

4. A combing cylinder as set forth in claim 3, wherein said teeth of said combing segment are arranged at a predetermined distance behind said front end of said wing-shaped profile of said combing segment.

5. A combing cylinder as set forth in claim 1, wherein said portion of said outer curved surface of said body defining said air flow passageway with said inner surface of said combing segment has a continuous curved form.

6. A combing cylinder as set forth in claim 1, wherein said combing segment is secured to said body of said cylinder by means of fastening flanges arranged at said front and rear ends of said combing segment.

7. A combing cylinder as set forth in claim 1, wherein said wing-shaped combing segment has teeth extending from said outer surface thereof, said teeth decreasing in size from said front end to said rear end of said combing segment.

8. A combing cylinder as set forth in claim 1, wherein a spoiler is arranged adjacent said rear end of said wing-shaped combing segment.

9. A combing cylinder as set forth in claim 1, wherein the wing-shaped profile of the combing segment is thicker at said front end thereof.

* * * * *